US008770130B2

(12) United States Patent
Holmes

(10) Patent No.: US 8,770,130 B2
(45) Date of Patent: Jul. 8, 2014

(54) DOCK-SIDE CRADLE

(76) Inventor: Richard A Holmes, Kamloops (CA)

( * ) Notice: Subject to any disclaimer, the term of this patent is extended or adjusted under 35 U.S.C. 154(b) by 171 days.

(21) Appl. No.: 13/214,931

(22) Filed: Aug. 22, 2011

(65) Prior Publication Data

US 2012/0152163 A1 Jun. 21, 2012

(30) Foreign Application Priority Data

Dec. 20, 2010 (CA) ..... 2725974

(51) Int. Cl.
*B63B 35/44* (2006.01)

(52) U.S. Cl.
USPC ..... 114/263; 114/45; 405/7

(58) Field of Classification Search
USPC ..... 114/44, 45, 48, 258, 263, 362; 405/1, 2, 405/3, 7
See application file for complete search history.

(56) References Cited

U.S. PATENT DOCUMENTS

| | | | | |
|---|---|---|---|---|
| 5,795,098 | A * | 8/1998 | Rueckert | 114/263 |
| 5,855,180 | A * | 1/1999 | Masters | 114/263 |
| 6,131,528 | A | 10/2000 | Meek et al. | |
| 7,182,030 | B2 | 2/2007 | Privette | |
| 7,481,175 | B2 * | 1/2009 | Dickman | 114/263 |
| 8,256,366 | B2 * | 9/2012 | Imel et al. | 114/263 |
| 2005/0082325 | A1 | 4/2005 | Bourne | |
| 2010/0247243 | A1 | 9/2010 | Imel et al. | |

* cited by examiner

*Primary Examiner* — Lars A Olson
(74) *Attorney, Agent, or Firm* — Nexus Law Group LLP

(57) ABSTRACT

A dock-side cradle for providing a safe point of entry into and out of a personal watercraft such as a canoe or kayak launching and landing same. The cradle is trough-shaped and is open at each end, with a slight slope from one end to the other. Preferably the trough is defined by a plurality of support arms in spaced separation from one another which are connected to a pair of guiding elements. The cradle is adapted to be hingedly connected to a dock so that it can be positioned in the water for use, or rotated up onto the dock when not in use. The cradle is equipped with handrails connecting to the support arms and the support arms themselves may be extendable in order to accommodate varying water levels in relation to the dock. The cradle may be sold as a kit.

15 Claims, 8 Drawing Sheets

DOCK-SIDE CRADLE

FIELD OF THE INVENTION

The present invention relates to a dock-side cradle for supporting a personal watercraft, such as a canoe or kayak, in the water so as to allow a user to more easily enter and exit the watercraft and to launch and retrieve it.

BACKGROUND OF THE INVENTION

Canoes and kayaks have been around for thousands of years and remain popular today. These human powered personal watercraft are used on lakes, rivers and oceans—pretty much anywhere there is water.

While kayaks are generally more "tippy" than canoes, both suffer from stability issues that can make it difficult to enter and exit without capsizing. This can be especially difficult in areas without suitable shoreline for launching the canoe or kayak. For those individuals having waterfront property with a dock, entry into the canoe or kayak is not much easier. When entering the canoe or kayak, the individual must transfer their bodyweight to the lateral center line of the watercraft in order to avoid tipping. This can be very difficult when stepping off a dock.

In order to make the process of getting into and out of a canoe and kayak easier, a number of devices have been developed. At the most basic, a wooden boat ramp designed with a shallow slope entering the water simulates a beach or the like. The canoe or kayak can be pushed substantially into the water, leaving only a portion on the boat ramp thereby providing a stable surface from which to enter the canoe or kayak. However, these boat ramps are most effective when others are available to hold the end of the canoe or kayak steady while the user enters the watercraft. Those making use of the ramp on their own are still faced with the prospect of capsizing when trying to enter or exit the watercraft or are faced with difficulty in launching the watercraft if it was positioned too high on the ramp in order to make entry easier.

More complicated docking systems have been designed with a built-in sloped launching platform. However, these are large, costly systems that take up a great deal of space and are not adapted to make use of existing docks.

To date, there have been no simple designs for a dock-side cradle to assist with the entry and exit of a canoe or kayak.

Accordingly, it is an object of an embodiment of the present invention to provide a dock-side cradle designed to make dock-side entry and exit of a kayak or canoe straightforward and safe.

Other objects of the invention will be apparent from the description that follows.

SUMMARY OF THE INVENTION

The invention consists of a dock-side cradle for connecting to a dock and supporting a personal watercraft during entry and exit. Preferably, the dock-side cradle comprises a plurality of trough-shaped support arms in spaced separation from one another, each support arm connected at one end to the dock. A pair of guiding elements is connected to the support arms for guiding a personal watercraft into and out of the cradle and for supporting the watercraft while in the cradle. At least one railing is connectable to at least one of the support arms, the railing providing a user with an added support point when entering a personal watercraft positioned in the cradle and to aid with moving the personal watercraft into and out of the cradle.

In another aspect of the invention the plurality of trough-shaped support arms are hingedly connected to the dock.

In another aspect, each of the support arms is u-shaped. The u-shape is defined by a pair of vertical arms bordering a V-shaped angled bottom.

In one embodiment, each of said plurality of supports arms is connected to an elongated connecting element, the elongated connecting element being connectable to the dock. The support arms are hingedly connected to the elongated connecting element such that the cradle is hingedly connectable to the dock, so that it can be pivoted into and out of the water as necessary.

In an alternative embodiment, each of said plurality of support arms is connected to a respective connecting element, each of said respective connecting elements being connectable to the dock. The support arms are hingedly connected to the respective connecting elements such that the cradle is hingedly connectable to the dock and pivotable relative thereto.

In another aspect, the support arms may comprise a telescoping elevator arm allowing the depth of the cradle to be varied to accommodate varying water levels in relation to a fixed dock.

In another aspect, at least one of the support arms may be equipped with braces to provide added structural rigidity.

It is also contemplated that the cradle could be sold as a kit comprising the various components of the cradle, with the guiding elements being optional, as they could be obtained by the customer directly.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

These and other features of the invention will become more apparent from the following description in which reference is made to the appended drawings and wherein.

DESCRIPTION OF THE PREFERRED EMBODIMENTS

Figure 1:
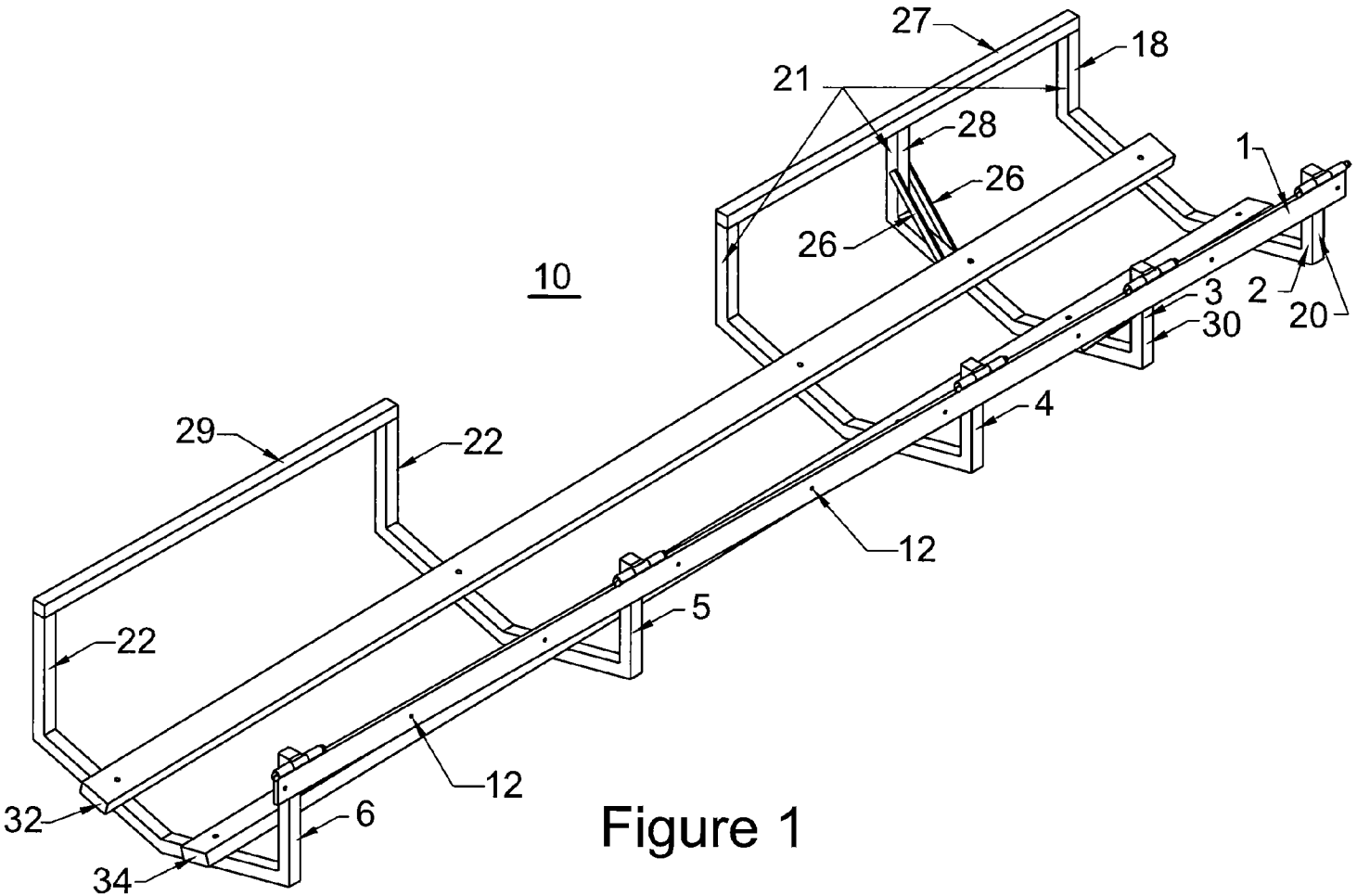
FIG. 1 is a perspective view of a dock-side cradle according to the present invention.

A dock-side cradle 10 according to the invention is shown in FIG. 1. The cradle 10 is generally trough-shaped, each end of the trough terminating in an open end, with the size of the trough increasing slightly in depth, from one end to the opposite end. The cradle 10 is releasably connectable to a dock and is shaped so as to allow a personal watercraft such as a canoe or kayak to be launched and retrieved within the confines of the trough, providing support for a watercraft so that the watercraft remains stable while a user enters and exits the watercraft. Preferably, the cradle 10 is hingedly connected to the dock so that it can be raised and lowered into the water as needed.

The cradle will now be discussed in more detail. The trough is defined by a plurality of trough-shaped support arms or ribs 2, 3, 4, 5, 6 in spaced separation from one another. Each support arm 2, 3, 4, 5, 6 is hingedly connected at one end to a longitudinally extending connecting element 1 and fixedly connected to one of two handrail elements 27, 29 at the opposite end as shown in FIG. 1. A pair of longitudinally extending guiding elements 32, 34 are connected to the support arms. Preferably, the depth of the support arms increase, with support arm 2 being the shallowest and support arm 6 being the deepest. While not limiting, the preferred embodiment of the cradle will be discussed with reference to an example of dimensions to be adopted for the various elements for use with a kayak or canoe having a width of 30" and for a floating dock where the water level is constant at 8½" below the top of the dock. Of course, it is contemplated that the dimensions can be altered to accommodate different sized watercraft and for different water conditions.

Preferably, the connecting element 1 is in the form of aluminum flat bar, but could be made of other suitable material. For example, the inventor has found that a 12' piece of 3"×½" aluminum flat bar is a suitable connecting element 1. The connecting element 1 has a plurality of holes 12 punched through it. Preferably, the connecting element 1 is connected to a dock using a plurality of lag bolts that are inserted through the holes 12 and into the dock (either along the side or on top adjacent a side).

The support arms 2, 3, 4, 5, 6 are connected to the connecting element 1 in spaced separation with one another and increase in depth from support arm 2 in the direction of support arm 6. Preferably, with a 12' connecting element 1, support arm 2 is spaced approximately two feet from support arm 3 and support arm 3 is approximately two feet from support arm 4. The first three support arms form a support portion 21 of the cradle 10 for supporting a watercraft during entry into and exit from the watercraft and are therefore positioned closer together. Support arm 4 is preferably spaced approximately four feet from support arm 5 and support arm 5 is also spaced approximately four feet from support arm 6. Support arms 5 and 6 form a guide portion 22 of the cradle 10 for guiding a watercraft into and out of the support portion 21. The increasing depth of the support arms is designed so that a user and watercraft are supported firmly out of the water in the support portion 21 to allow easy entry and exit into the watercraft, but then can float freely when exiting or entering the cradle 10.

Figure 2:
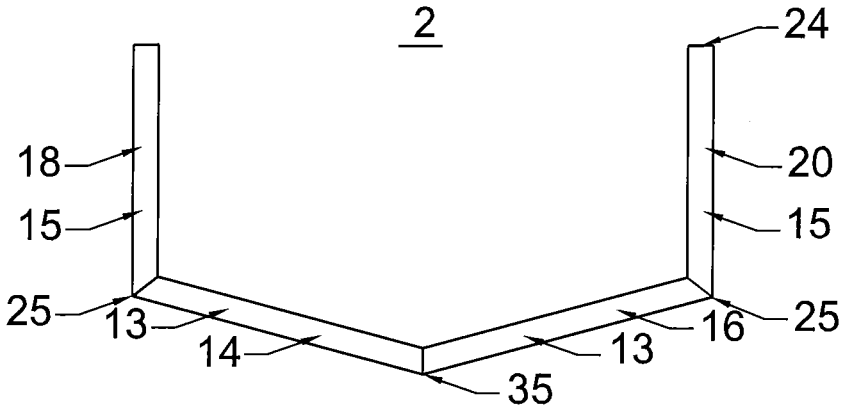
FIG. 2 is a side view of one of the support arms of the cradle shown in FIG. 1.

The support arms will be described in more detail with reference to FIGS. 2 and 3. In FIG. 2, support arm 2 is shown in isolation. Support arm 2 has a "v" shaped angled bottom 13 formed of a pair of angled bottom pieces 14, 16 which are preferably welded together, although other suitable connecting techniques could be used. Each angled bottom piece is connected to a respective side arm 15, with bottom piece 14 connected to outside arm 18 and bottom piece 16 connected to inside arm 20. It is also contemplated that the support arm could be formed of a single piece of material (aluminum or other metal) that is bent into the desired shape, or single piece of material (such as plastic or the like) which is molded or machined into the desired shape. The outside arm 18 and inside arm 20 form the sides of the trough of the cradle 10. Continuing with the cradle example for a 30" watercraft, preferably, the side arms 18, 20 are 9¼" in length for support arm 2 (assuming water that is 8½" below the top of the dock).

The other support arms 3, 4, 5 and 6 are identical in construction to support arm 2, but have different dimensions. Preferably, the side arms 15 of the support arms lengthen by 1½" for every 4' length of the cradle, although this could be varied to create an increased or decreased slope. For example, the side arms of support arm 2 are preferably 9¼", followed by 10" for support arm 3, then 10¾" for support arm 4, 12¼" for support arm 5, and 13¾" for support arm 6. Preferably the side arms 15 are square on top 24 and cut at a 37.5 degree angle on the bottom 25.

Figure 3:
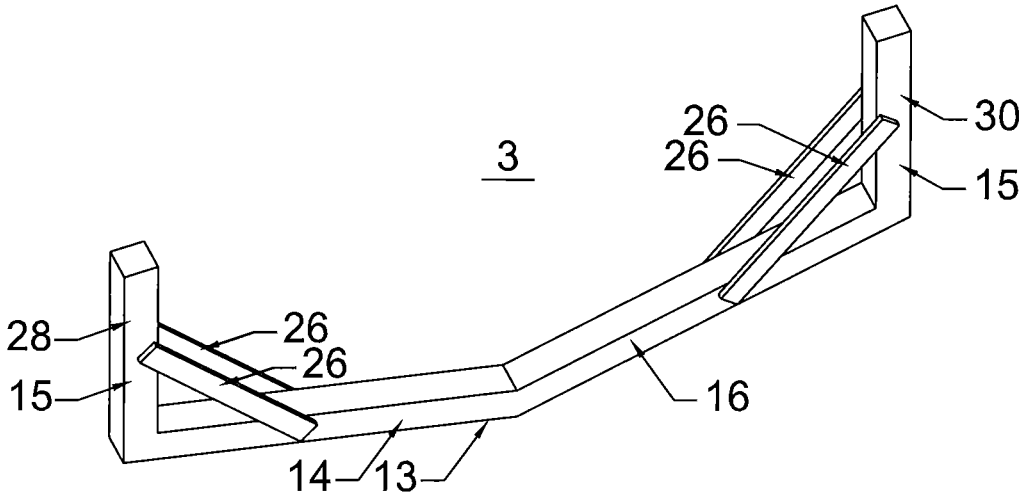
FIG. 3 is a side view of another of the support arms of the cradle shown in FIG. 1, this one equipped with added braces.

Referring to FIG. 3, the second support arm 3 is shown in isolation. In addition to having inside side arm 30 and outside side arm 28 which are slightly longer than the side arms 18, 20 of support arm 2, support arm 3 is also shown equipped with two pairs of angled braces 26 which are connected to each side of the inside and outside arms and to the angled bottom. The braces 26 provide added strength and rigidity to the cradle in the support portion 21 where you enter and exit the kayak. Additional braces could be added to other support arms. For the example discussed, the braces are made from 1"×¼" aluminum flat bar which are welded to the support arms. It is also contemplated that the braces could be left off the design in cases where they are unnecessary for the strength and rigidity required of the cradle.

The angled bottom pieces 14, 16 have holes drilled in them for attaching the longitudinally extending guiding elements 32, 34, which provide added structural rigidity to the cradle 10 and act to help align the watercraft when entering and exiting the cradle and support the watercraft when it is positioned in the cradle. Preferably the guiding elements 32, 34 are 12' cedar 2×4's which are connected to each angled bottom piece with 3" S.S. ¼" bolts and self-locking nuts. Preferably, the holes in the angled bottom pieces 14, 16 are drilled 7¼" from the centerline 35 of the angled bottom 13 (shown in FIG. 2). Matching holes are drilled in the cedar 2×4's and the bolt heads are countersunk so that they do not touch the kayak when using the cradle. It is also contemplated that other suitable materials could be used as guiding elements, including plastic, engineered wood products and the like. It is also contemplated that guide wheels or the like could be added to make launching and recovering the watercraft easier.

Referring to FIG. 1, a first railing 27 is shown connected to the tops of the outside arms of the first three support arms 2, 3, 4. A second railing 29 is connected to the tops of the outside arms of the final two support arms 5, 6. Preferably the railings 27, 29 are 4' long and are made from 1½" square aluminum tubing. They can be welded or otherwise connected to the tops of the outside arms of the support arms. Handles can be added to the dock to aid in entering and exiting the cradle. Two small holes can be drilled in the top of each railing to drain any water that enters through the welds.

Figure 4:
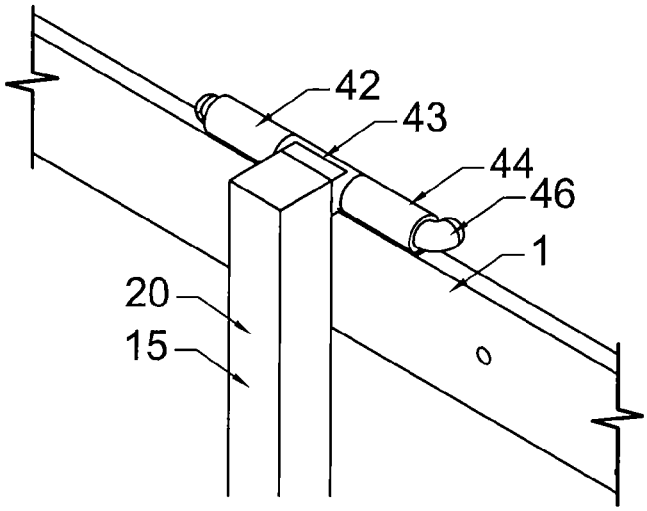
FIG. 4 is a perspective view of a hinge portion of the cradle of FIG. 1.
Figure 4A:
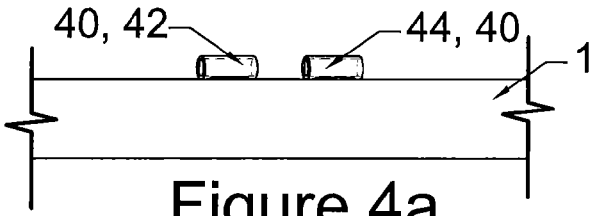
FIGS. 4*a*-4*d* are side views showing various elements of the hinge portion.
Figure 4B:
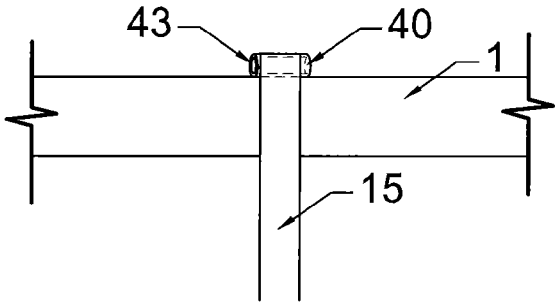
Figure 4C:
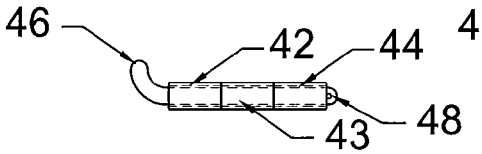
Figure 4D:
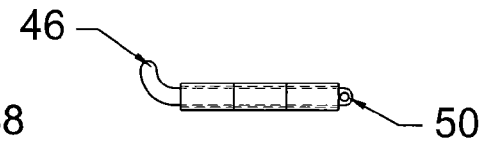

Referring to FIGS. 4 to 4*d*, the hinged connection between the support arms and the connecting element 1 will be described in more detail. As discussed above, the cradle is hinged so that it can be rotated up onto the dock (for example, to get it out of rough water) when it is not in use. The hinges 41 (shown in FIGS. 6, 7 and 9) are preferably constructed from fifteen pieces of 1" aluminum pipe 40, each 2" long. Five of the 2" pieces of aluminum pipe 43 are welded to the uppermost edge of the outer facing side of the five inside arms of the support arms 2, 3, 4, 5, and 6. The other ten of the 2" pieces of aluminum pipe 40 are welded to the top of the flat bar 1, two pieces 42, 44 in spaced separation so as to straddle the various pieces 43 welded to the top side of each inside arm. The hinge is formed by aligning the three respective pieces of aluminum pipe 42, 43 and 44 and inserting an iron pin 46 through them. This iron pin 46 is preferably held in place by cotter pins (not shown) placed in a 3/16" hole 48 bored in the end of the iron pin. Preferably, one hole 50 in one of the pins is bored larger (5/16") than the others so that a padlock can be used (in place of a cotter pin) to prevent theft. It is also contemplated that other hinge systems could be used for the cradle 10 provided the hinges allow the cradle to be connected to a dock and still rotate freely into and out of the water.

Figure 5:
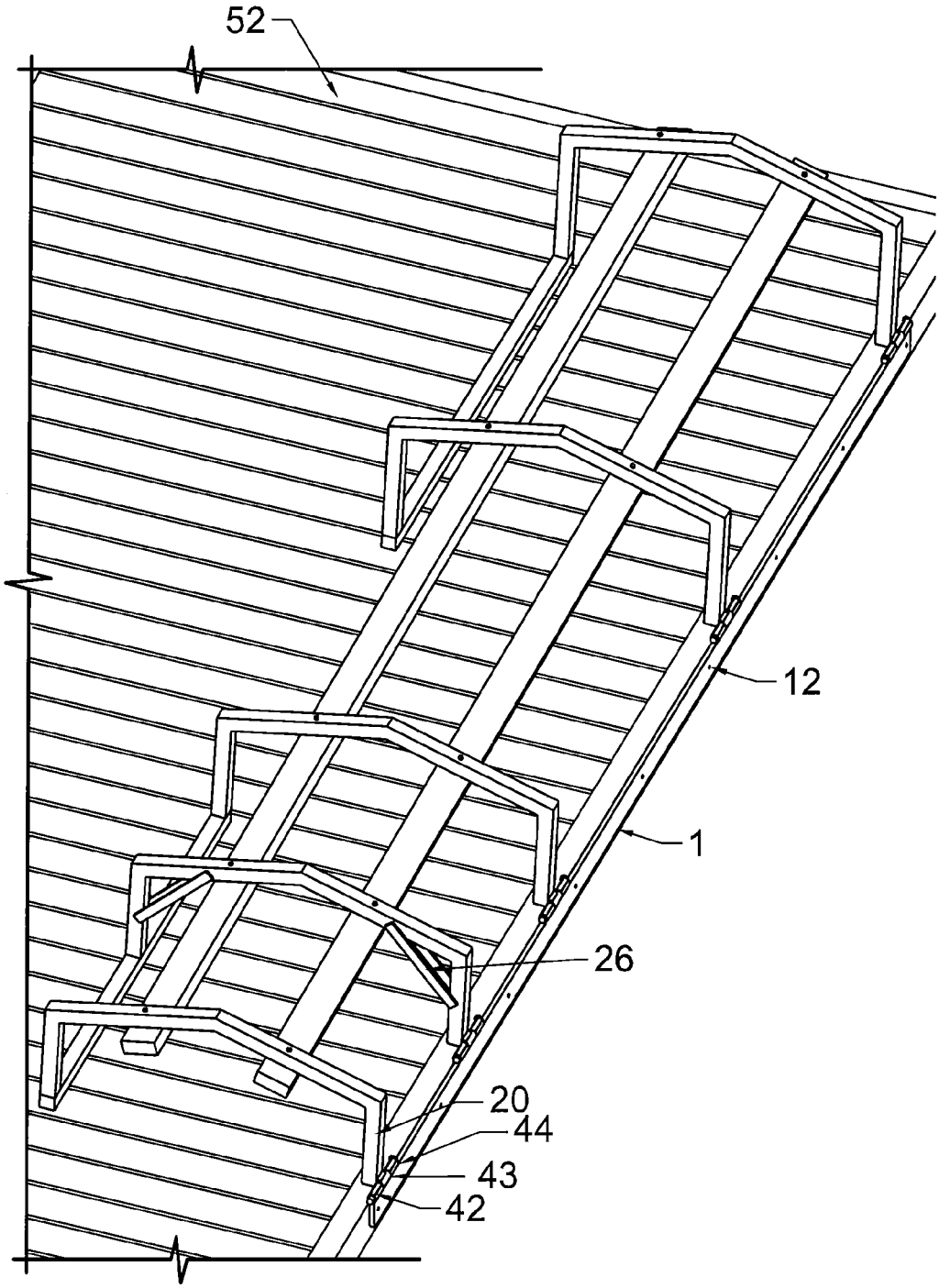
FIG. 5 is a perspective view showing the cradle 10 attached to a dock and positioned on the dock.

The entire cradle 10 can be rotated on the five hinges out of the water and up onto a dock 52 when not in use, as shown in FIG. 5. When rotated up onto the dock, any water entering the aluminum tubes (through welds, bolt holes or other openings) will drain through the small holes drilled in the top of the railing.

While the preferred embodiment has been described with reference to specific dimensions and materials, it is understood that the size and material used could be altered without departing from the spirit of the invention. In particular, the dimensions described above are for a cradle designed to accommodate a kayak or canoe that is approximately 30" wide. The width and depth of the cradle can be varied to accommodate various sizes of canoe, kayak or similar personal watercraft. Similarly, while the preferred embodiment makes use of welded aluminum and wood, it is contemplated that other materials could be used including molded plastic, other metals, engineered wood products, or other suitably rigid material.

In addition to being built in different sizes to correspond to different sized watercraft, the cradle 10 dimensions can also be altered for different dock setups. For example, the lengths of the inside and outside arms can be adjusted for water that is not 8½" below the top of the dock. The length of the angled bottom pieces can be adjusted for a watercraft that is not 30" wide. It is also contemplated that the cradle could be shortened to be comprised of only the supporting portion 21, such that it has only 3 support arms. This would reduce the size and weight of the cradle, but would also make launching and retrieving a watercraft from the cradle more difficult. The overall length of the cradle can also be adjusted as necessary to accommodate different sized watercraft.

Figure 6:
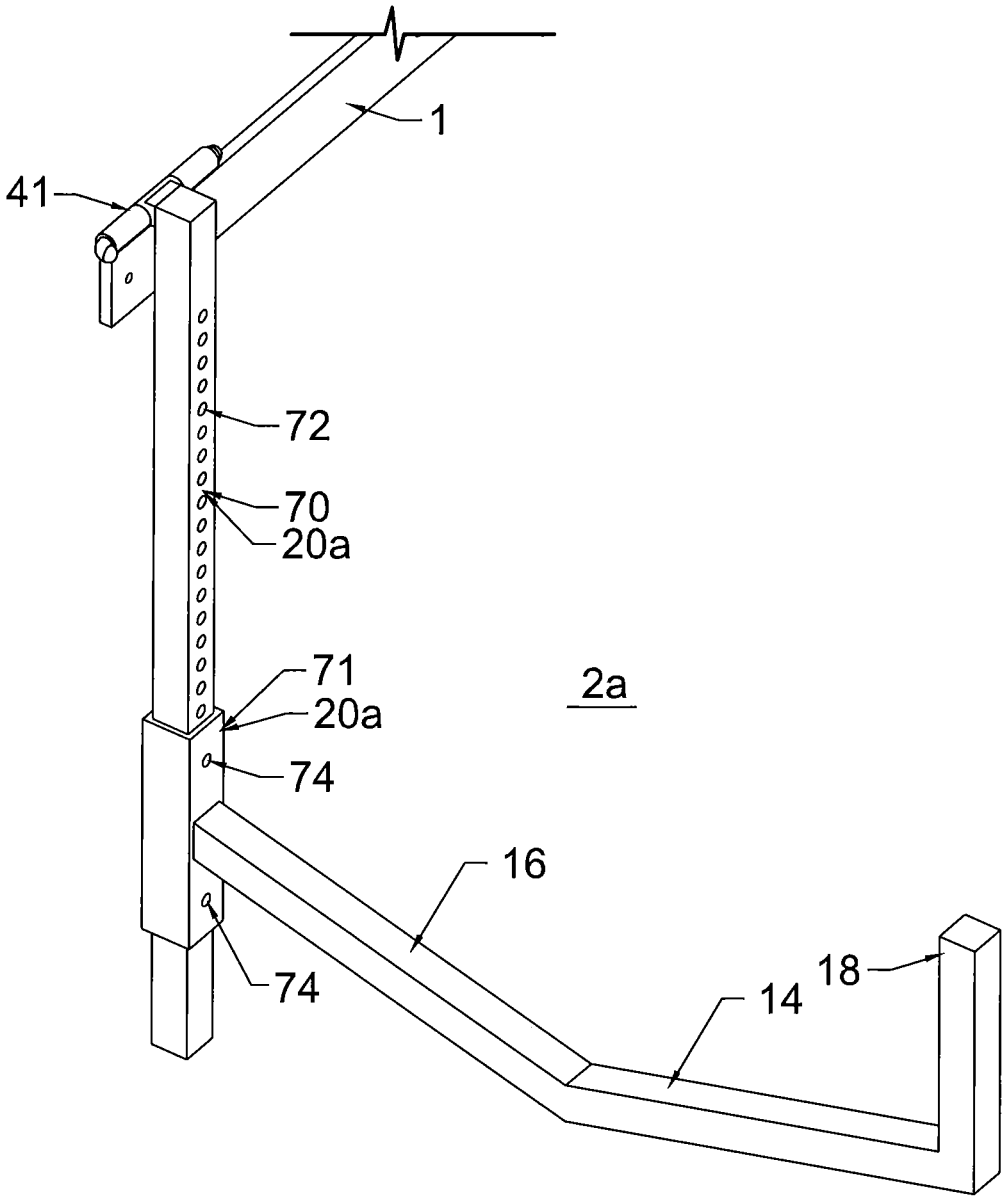
FIG. 6 is a perspective view showing an alternative embodiment of a support arm according to an embodiment of the invention adapted for use with a fixed rather than floating dock.

An alternative embodiment of a support arm 2*a* is shown in FIG. 6. Support arm 2*a* is adapted for a cradle to be used with a fixed dock where the water level varies in relation to the dock as opposed to a floating dock where the water level remains constant as compared to the dock. Much of the design remains unchanged with a fixed dock, and identical reference numbers have been used to identify identical portions of support arm 2*a*. In addition, the cradle construction remains the same as described above.

Instead of a fixed inside arm, support arm 2*a* (and in turn the other support arms of the cradle) is equipped with a telescoping inside arm 20*a*. The telescoping arms of the support arms are used to adjust the level of the cradle as necessary to accommodate the varying water level (relative to the dock). Preferably, telescoping arm 20*a* comprises an elevator arm 70 and an inside arm guide element 71. Elevator arm 70 is connected to connecting element 1 at one end by way of hinge 41 (discussed in detail above) and is movable within, and releasably connectable to (preferably by bolting as discussed below), inside arm guide element 71. The elevator arm 70 preferably has a plurality of holes 72 through the elevator arm for aligning with the anchor holes 74 which travel through the inside arm guide element 71, which is preferably attached at the middle to the inside angled bottom piece 16 by welding or other suitable connection method.

Preferably, the inside arm guide element 71 is made of a straight and hollow piece of 2" square aluminum pipe that is 9" long, such that it extends approximately 4½" on either side of the midpoint of the inside angled bottom piece 16 as shown in FIG. 6. For the 9" inside arm guide element, it is preferred that the two anchor holes 74 are positioned 1½" from either end of the 9" pipe (spacing the anchor holes 74 six inches from each other). The elevator arm 70 is preferably made from 1½" square aluminum pipe with holes drilled for pinning the elevator arms at different levels. These holes are preferably adapted for ¼" S.S. bolts and can be drilled at different levels for the different support arms (the support arms once again increasing in depth from one end to the other in order to slope the cradle into the water).

For example, for a cradle having elevator arms that are each 36" long, the elevator arm 70 of the first support arm 2*a* would preferably have the first hole 72 drilled 4½" from the top of the elevator arm 70 with a further hole 72 drilled every inch from that point until 29½" from the top (6½" from the bottom). For the elevator arm of the second support arm (corresponding to support arm 3 of cradle 10) the first hole would be drilled 5¼" from the top of the arm followed by 26 holes, each 1" apart, ending at the 30¼" point on the arm. This continues, with the elevator arm for the third support arm having the first hole drilled 6" from the top, the fourth elevator arm having the first hole drilled 7½" from the top and the fifth elevator arm having the first hole drilled 9" from the top (each with a further 26 holes spaced 1" apart).

When a user goes to position the support arms of the cradle for use with a given water level, they must properly adjust the telescoping inside arms by aligning the holes 72 and 74 of the elevator arm 70 and inside arm guide element 71 and then inserting pins through the same relative holes in each elevator arm. For example, when set for the minimum depth, a first pin would be inserted through the top hole 72 with a second pin inserted through the seventh hole 72 (6" apart). This is repeated for each telescoping inside arm.

Figure 7:
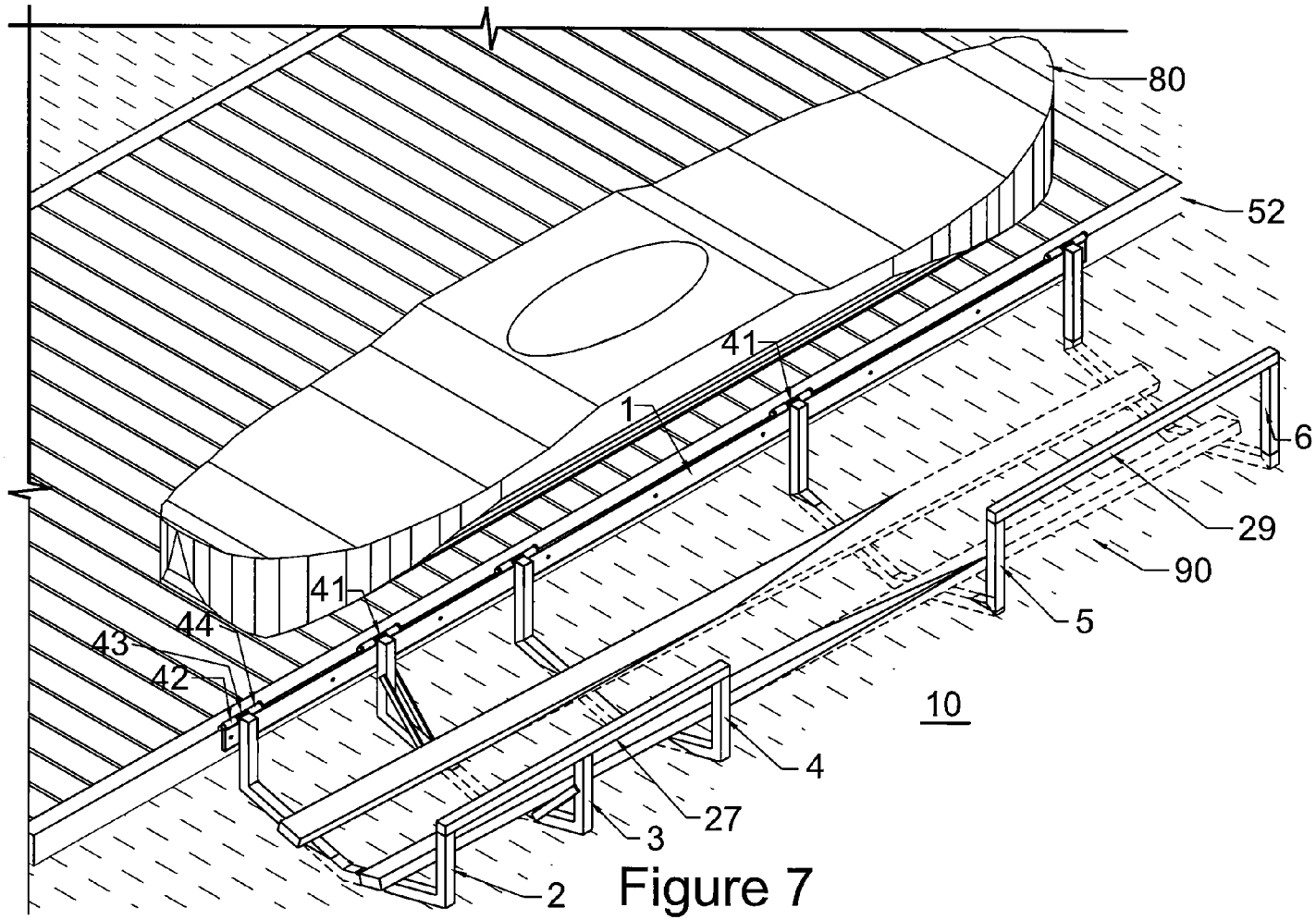
FIG. 7 is a perspective view of the cradle of FIG. 1 shown connected to a dock and positioned in the water ready for use.
Figure 8:
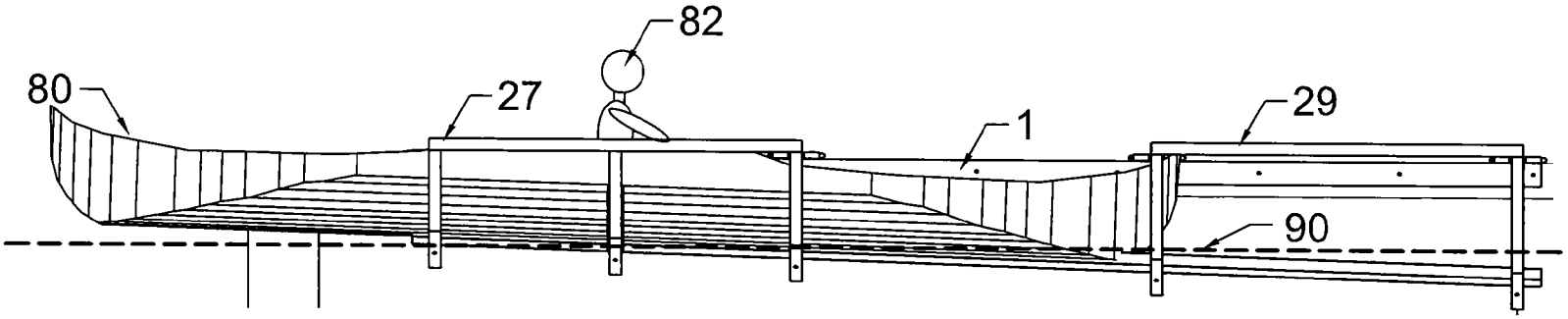
FIG. 8 is a side view showing a kayak seated within the cradle of FIG. 1.
Figure 9:
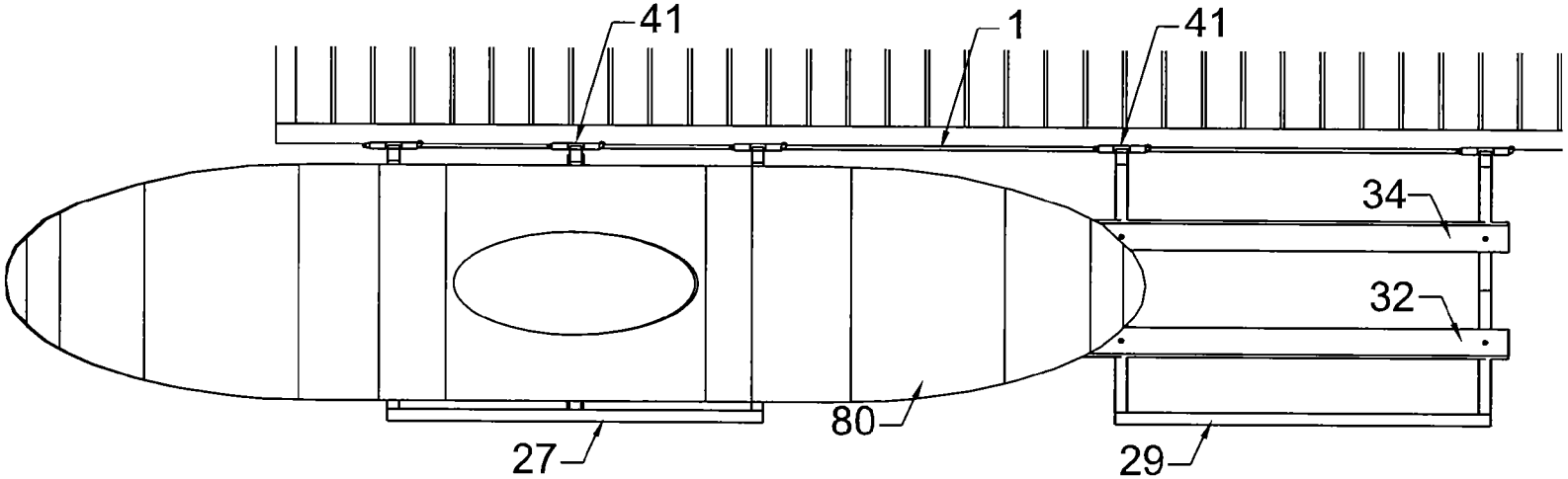
FIG. 9 is a top view showing a kayak seated within the cradle of FIG. 1.

FIGS. 7, 8 and 9 show the cradle 10 in use. In FIG. 7, the cradle is shown attached to the dock 52 and in position in the water, with a kayak 80 located on the dock. In FIG. 8, the kayak 80 is shown positioned in the cradle 10 with a user 82 seated in the kayak and holding onto the handrail 27. Once comfortably seated in the kayak 80, the user can use the handrail to help launch the kayak down the sloping cradle and into the water 90. When landing the watercraft, the handrails can also be used to force the watercraft up the cradle. FIG. 9 provides a further top view showing a kayak 80 positioned in the support position of the cradle.

Figure 10:
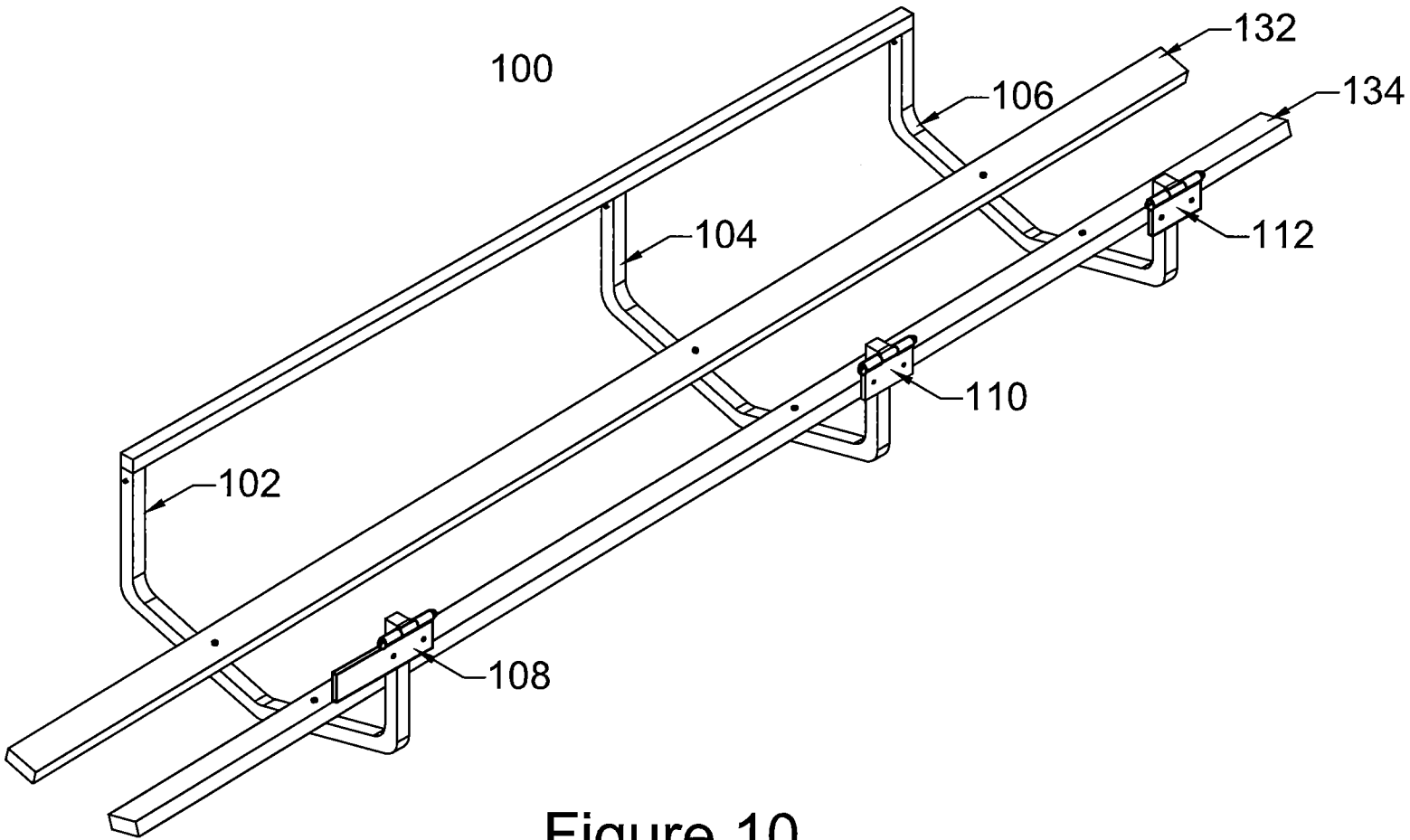
FIG. 10 is a perspective view of an alternative embodiment of a dock-side cradle according to the present invention.

A further alternative embodiment is shown in FIG. 10. A modified cradle 100 is shown in which only three support arms, referred to by reference numbers 102, 104 and 106, are used. Support arms 102, 104 and 106 are formed of aluminum that has been bent to the desired shape rather than cut and welded as discussed above. In addition, rather than being connected to one elongated member, each individual support arm 102, 104 and 106 is connected to its own respective connectors 108, 110 and 112, respectively. Preferably, each of the connectors 108, 110 and 112 is in the form of a piece of aluminum flat bar that is hingedly connected to the support arm and which can be connected to a dock using lag bolts. For example, a six inch piece of flat bar has been found to be suitable. As shown in FIG. 10, connector 108 is approximately double the size of connectors 110 and 112 in order to provide a space for the inclusion of a company Trademark, Tradename, contact information or the like (for example on a label attached to the connector 108 in the unused space provided). This is a purely cosmetic choice and does not affect the functionality of the cradle.

As described previously with regards to the preferred embodiment, the depth of the support arms increases from one end of the cradle 100 to the other. As shown, support arm 106 is the shallowest and support arm 102 is the deepest. The support arms 102, 104 and 106 are all connected to a railing 114. Preferably the railing 114 is in the form of a square aluminum pipe which can be fixedly or detachably connected to the support arms. For example, railing 114 could have short and small pieces of square aluminum pipe welded to it in spaced separation to one another corresponding to the desired spacing for the support arms, the pieces of pipe sized to fit inside the vertical outside arm of the three ribs with connection completed by bolting or the like.

For the cradle 100 shown in FIG. 10, the ribs would be spaced 2 feet (rib 106), 5 feet (rib 104), and 10 feet (rib 102) from a first end of the longitudinally extending guide/support elements 132 and 134.

It is also contemplated that modified cradle 100 could be equipped with the telescoping arms shown in FIG. 6 and discussed above in order to allow the cradle to be used with a fixed dock that would be subject to fluctuating water levels.

It is contemplated that the cradle could be sold as a kit including the various components discusses above along with any required additional parts (lag bolts, etc.), with guiding elements as an optional component, as the customer could supply these themselves. Materials to aid in the assembly of the cradle could be included. In addition, a length of rope could be provided to be used for raising and lowering the cradle when it is pivoted in and out of the water. Other suitable items, such as a gaff for retrieving the rope connected to the cradle, could also be included.

It will be appreciated by those skilled in the art that the preferred and alternative embodiments have been described in some detail but that certain modifications may be practiced without departing from the principles of the invention.

What is claimed is:

1. A dock-side cradle for connecting to a dock and supporting a personal watercraft during entry and exit comprising:

a plurality of trough-shaped support arms in spaced separation from one another, each support arm being connectable at one end to said dock;

a pair of guiding elements connected to said support arms;

at least one railing connectable to at least one of said support arms; and wherein each of said plurality of trough-shaped support arms is U-shaped, and wherein said U-shape is defined by a pair of vertical arms and a V-shaped angled bottom.

2. The dock-side cradle of claim 1 wherein each of said plurality of support arms is connected to an elongated connecting element, said elongated connecting element being connectable to said dock.

3. The dock-side cradle of claim 2 wherein said elongated connecting element is hingedly connected to said support arms such that said cradle is hingedly connectable to said dock.

4. The dock-side cradle of claim 1 wherein each of said plurality of support arms is connected to a respective connecting element, the respective connecting elements being connectable to said dock.

5. The dock-side cradle of claim 4 wherein each of said respective connecting elements is hingedly connected to said plurality of support arms such that said cradle is hingedly connectable to said dock.

6. The dock-side cradle of claim 1 wherein said plurality of support arms comprise a telescoping elevator arm.

7. The dock-side cradle of claim 1 wherein said plurality of trough-shaped support arms are hingedly connectable to said dock.

8. The dock-side cradle of claim 1 wherein said vertical arms of each of said plurality of support arms being a different length such that said guiding elements slope from a first end to a second end.

9. A dock-side cradle for connecting to a dock and supporting a personal watercraft during entry and exit comprising:

a plurality of trough-shaped support arms in spaced separation from one another, each support arm being connectable at one end to said dock;

a pair of guiding elements connected to said support arms;

at least one railing connectable to at least one of said support arms; and wherein said plurality of trough-shaped support arms comprises at least three support arms.

10. The dock-side cradle of claim 9 wherein each of said plurality of support arms is connected to an elongated connecting element, said elongated connecting element being connectable to said dock.

11. The dock-side cradle of claim 10 wherein said elongated connecting element is hingedly connected to said support arms such that said cradle is hingedly connectable to said dock.

12. The dock-side cradle of claim 9 wherein each of said plurality of support arms is connected to a respective connecting element, the respective connecting elements being connectable to said dock.

13. The dock-side cradle of claim 12 wherein each of said respective connecting elements is hingedly connected to said plurality of support arms such that said cradle is hingedly connectable to said dock.

14. The dock-side cradle of claim 9 wherein said plurality of support arms comprise a telescoping elevator arm.

15. The dock-side cradle of claim 9 wherein each of said at least three support arms being a different depth such that said guiding elements slope from a first end to a second end.

* * * * *